United States Patent [19]

Powell, Jr.

[11] Patent Number: 4,583,440

[45] Date of Patent: Apr. 22, 1986

[54] CAPO FOR GUITAR AND BANJO

[76] Inventor: Charles B. Powell, Jr., 8324 Saddle Trail, Fort Worth, Tex. 76116

[21] Appl. No.: 699,941

[22] Filed: Feb. 8, 1985

[51] Int. Cl.[4] ..... G10D 3/04
[52] U.S. Cl. ..... 84/318
[58] Field of Search ..... 84/318

[56] References Cited

U.S. PATENT DOCUMENTS

| | | | |
|---|---|---|---|
| 370,172 | 9/1887 | Wood | 84/318 |
| 416,057 | 11/1889 | Gill et al. | 84/318 |
| 4,143,576 | 3/1979 | Nichols et al. | 84/318 |

*Primary Examiner*—Lawrence R. Franklin
*Attorney, Agent, or Firm*—Charles D. Gunter, Jr.

[57] ABSTRACT

A capo for a guitar and five string banjo that is selectively mounted along the length of the guitar or five string banjo neck for retaining all of the strings of the guitar or four of the five strings of a five string banjo in abutting relation to the frets of the fretboard for the purpose of uniformly changing the pitch of the strings without the need for retuning the strings. The capo consists of a clamp frame that mounts a rubber strip for clamping against the strings and two integral handles that are grasped using either hand for operation and a coiled tension spring to provide the clamping force.

5 Claims, 10 Drawing Figures

FIG. 1
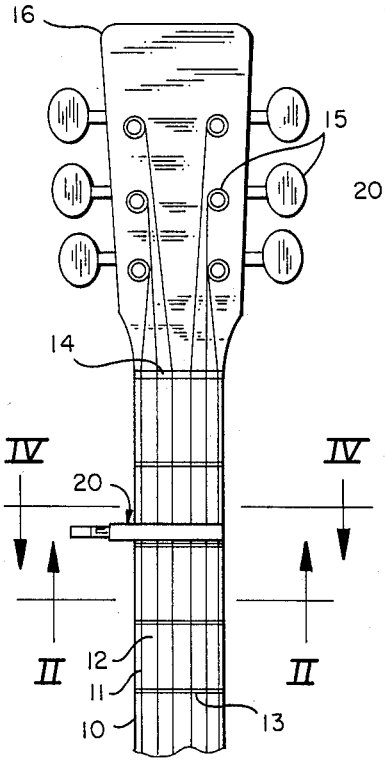
FIG. 3
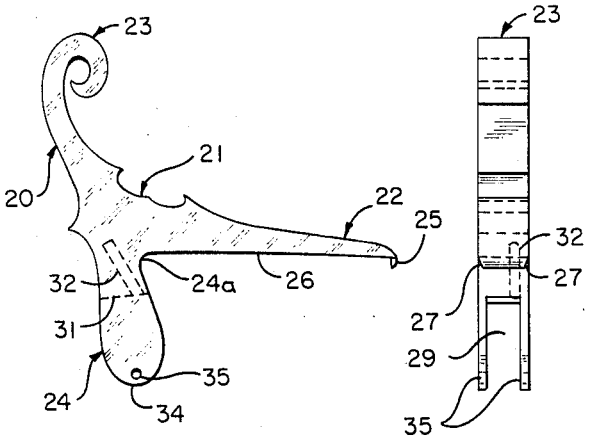
FIG. 4
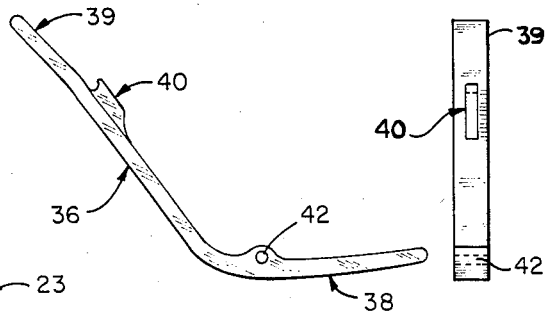
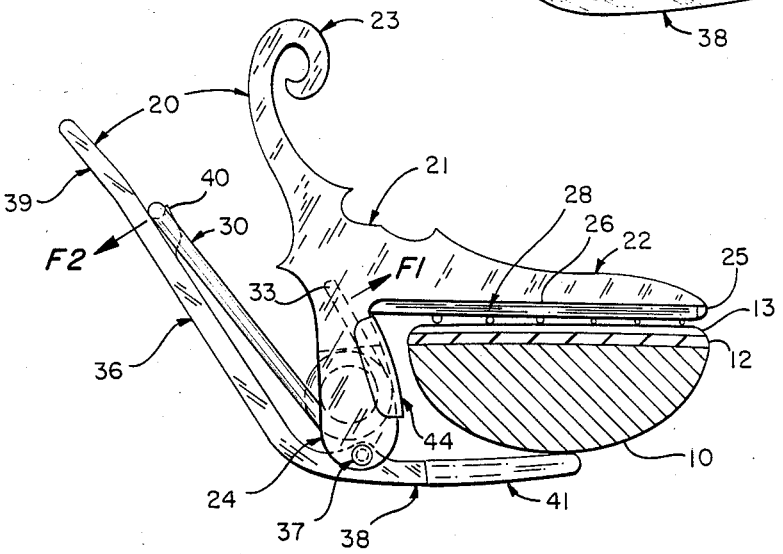
FIG. 2

CAPO FOR GUITAR AND BANJO

BACKGROUND OF THE INVENTION

1. Field of the Invention

This invention is a capo (clamp) for a guitar musical instrument and a capo for a five string banjo musical instrument. The capo is mountable on the neck of the musical instrument to change the pitch of the strings without the need for retuning.

2. Description of the Prior Art

A capo for changing the pitch of stringed musical instruments is known, typical is the method and apparatus for guitars disclosed in U.S. Pat. No. 4,143,576.

While the apparatus disclosed in the prior art presumably functions as a clamp for changing the instrument pitch, there is a need to provide a capo that performs the clamping function and additionally provides the capability for quick operation using either the left or right hand independently and additionally provides a construction configuration which when mounted on the instrument actually achieves the objective of not interfering with the musicians fretboard playing hand while the musician is playing difficult chords or individual notes near and about the mounted capo.

No prior art is known for a five string banjo capo which mounts the banjo neck from the side nearest the short fifth string, whereupon it clamps the four long strings to change the pitch of the four strings but does not engage or interfere with the short fifth string. This is a needed function for a five string banjo capo. Additionally, the five string banjo capo disclosed herein provides quick operation with either the left or right hand independently and is constructed to not interfere with the musicians fretboard playing hand while playing near and about the mounted capo.

The objective of this invention is to provide a capo which achieves the operational features described above.

SUMMARY OF THE INVENTION

This invention provides a capo apparatus which facilitates clamping of guitar strings (first embodiment) or five string banjo strings (second embodiment) against the frets on the neck of the instruments changing the pitch of the strings without the need for retuning the strings. The instrument strings are spaced above and along the fretboard of the instrument neck. The capo can be selectively mounted or removed, utilizing either hand, along the length of the instrument neck for the purpose of clamping all or a portion of the strings in abutting relationship to the frets of the fretboard. The capo consists of two clamping members, the upper member and the lower member. The upper member mounts a medium soft rubber strip which engages and presses the strings against the frets of the fretboard. The upper member also extends around the side of the neck to join, by means of a pivot pin, with the lower member. The lower member extends beneath the instrument neck to press against the lower side of the neck bringing the upper and lower members into a clamping action pressing the strings against the frets of the fretboard. The upper and lower members mount a coiled torsion spring which provides the capo clamping force. The upper and lower members embody integral handles for grasping with either hand and operation of the capo.

One objective of the invention is to provide a new and novel capo which can readily be mounted and removed along the length of a guitar or five string banjo neck, from one clamping position to another clamping position using either hand. Another objective of the invention is to provide in a capo, a new and novel mechanism engageable with the strings and neck of the guitar or five string banjo to clamp the strings against the frets of the fingerboard. Another objective of the invention is to provide a new and novel capo mountable on a guitar or five string banjo neck which achieves the feature of not interfering with the musicians fretboard playing hand while playing the instrument. Another objective of the invention is to provide a five string banjo capo which mounts on the banjo neck from the direction nearest the short fifth string, passing over the fifth string and engaging and clamping the four long strings against the frets of the fretboard while not engaging or interfering with the short fifth string.

BRIEF DESCRIPTION OF THE DRAWINGS

FIG. 1 is a partial plan view of a guitar neck portion and the first embodiment capo apparatus of this invention mounted thereupon.

FIG. 2 is a cross sectional view of the guitar neck taken along the line and in the direction of arrows 2—2 of FIG. 1, showing a side view of the first embodiment capo apparatus of this invention and internal structural lines.

FIG. 3 is a detail side view and end view of the upper member portion of the first embodiment capo apparatus of this invention showing external and internal structure.

FIG. 4 is a detailed side view and end view of the lower member portion of the first embodiment capo apparatus of this invention.

DETAILED DESCRIPTION OF THE INVENTION

Figure 5:
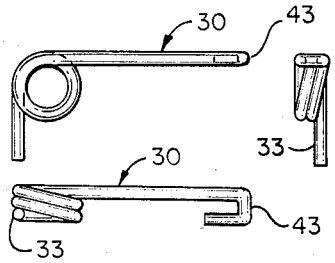
FIG. 5 is a detail three-view of the coiled tension spring of the capo apparatus of this invention showing structural configuration.
Figure 6:
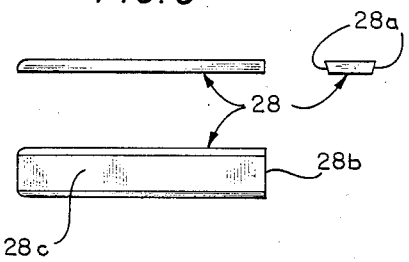
FIG. 6 is a detail three-view of the rubber strip of the first embodiment capo apparatus of this invention.

Referring to the drawings, particularly FIG. 1, there is shown a plan view of a neck portion of a six string guitar, generally designated 10, that illustrates the six strings 11 strung along the length of the fretboard 12 of the neck. The strings are spaced equal distance apart along the fretboard and spaced slightly above the metal frets 13 that are mounted on the fretboard, then the strings pass in abutting relation through the grooves of the nut 14 and finally terminate at the six tuning machine screw mechanisms 15 mounted on the headpiece 16 of the neck 10.

The first embodiment of the capo, generally designated 20, is shown in a mounted position on the neck in an operational condition. Referring to FIG. 2, there is shown a cross sectional view of the guitar neck portion generally taken along the line and in the direction of the arrows 2—2 of FIG. 1 that shows a side view of the first embodiment capo apparatus of this invention in a clamped condition on the neck.

Referring to FIGS. 2–6 the first embodiment of the capo of this invention 20, consists of the upper member, generally designated 21, that has a long tapering portion, generally designated 22, which extends across the width of the guitar fretboard. The upper member portion 22 terminates at the small end with a downward projecting curved lip 25 that forms one end of a downward facing curved recess 26 which is generally terminated at the opposite end by the inside surface 24*a* of the upper member downward projecting leg, generally designated 24. The curved recess 26 forms the mounting surface for the medium soft rubber strip, generally designated 28. The rubber strip 28 is glued inside the recess 26 to permanently fasten the rubber strip 28 and upper member 21 in abutting relationship. The downward projecting leg 24, that is a portion of the upper member 21, is slotted 29 to form a recess in which the coiled torsion spring, generally designated 30, is retained. The walls of the slot 29 restrict the lateral movement and rotational freedom of the coiled torsion spring 30.

The base 31 of the slot 29 serves as a stop for the coiled tension spring movement in the upward direction. In the base 31 of the slot 29 is an elongated hole 32 into which the short portion of the coiled torsion spring 33 is inserted. The elongated hole 32 serves as the anchoring point for the short end portion of the spring, however, the spring is not rigidly held in the elongated hole. At the lower end of the downward projecting leg 34 two aligned holes 35 are located in the legs of the slot 29 to accept a metal pin 37 which joins the upper member 21 and lower member, generally designated 36. The upper member 21 has an upward projecting portion, generally designated 23, which is decorative in design but serves as a handle that is grasped by the hand to apply manual opening force to the upper member.

The lower member, generally designated 36, consists of portion 38 that generally extends beneath the neck 10 of the guitar. The extremity of portion 38 is covered by a soft plastic sleeve 41 which prevents scarring of the wooden guitar neck when the lower member portion 38 abuts the neck. A portion 39 of the lower member 36 extends in an upward but angled direction to form a handle for grasping by the hand and applying manual opening force to the lower member 36. The extremity of the lower member portion 39 consists of a raised portion 40 which serves as a guide and stop for the long end of the coiled torsion spring 43. The coiled torsion spring portion 43 fits about the raised portion 40 and abuts the handle portion 39 as shown in FIG. 2. The lower member 36 contains a hole 42 which is aligned with the upper member holes 35 into which the pivot pin 37 is inserted and braded at one end to permanently retain the pin within the three holes and the pin is the pivot for the upper and lower members.

The upper member down projecting leg 24 mounts a protective rubber piece, generally designated 44 which is glued in place and prevents scarring of the wooden neck 10 should the down projecting member 24 and the guitar neck 10 abut each other when the capo is mounted on the neck. The coiled torsion spring 30 is mounted to the upper member by inserting the short straight portion 33 into the elongated hole 32 in the upper member 21 as shown in FIG. 2. The long end of the coiled torsion spring 30 that contains two 90° bends at the terminating end 43 is mounted in abutting relation to the lower member 36 at the raised portion 40. The hook, formed by the two 90° bends, fits about the raised portion 40 as shown in FIG. 2. The raised portion 40 restrains the lateral motion of the spring hook end 43 to maintain proper alignment of the coiled torsion spring 30 and the lower member 36.

The coiled torsion spring 30 provides the clamping force for the capo. In the compressed condition, the spring short leg 33 transmits force to the upper member in the direction indicated by the arrow F1 in FIG. 2. The hook end 43 of the coiled torsion spring 30 transmits force to the lower member 36 in the direction indicated by the arrow F2 in FIG. 2. These two forces provide torsional forces acting about the pivot pin and urging the upper member portion 22 and the lower member portion 38 into a converging motion pressing the lower member portion 38 against the lower portion of the guitar neck and simultaneously bringing the rubber strip 28, mounted on the upper member portion 22, in contact with the strings and urging the strings 11 to abut the fret 13 on the fretboard 12 and finally clamping the strings 11 fully against the fret 13 to change the pitch of the strings.

The rubber strip material is medium soft rubber so that when the rubber strip abuts the instrument strings in the clamped condition each individual string will form a temporary indentation in the rubber. The depth of each indentation varies as a function of the clamping force, diameter of each string 11 and curvature of the fret 13 of the instrument. The curvature of the rubber strip 28 is fixed by the curvature of the recess 26 of the upper member portion 22. In the field of guitar products the curvature of the frets 13 vary from product to product. The non-rigid character of the medium soft rubber strip 28 and the "radius of curvature" of the recess portion 26 and the clamping force is sufficient to compensate for a large variation of guitar fret curvatures found in the field of the art. Some guitars in the art such as "Classic Guitars" do not have curved frets. In this case the recess portion 26 would be flat rather than curved. The rubber strip 28 is beveled on both sides 28*a* and matches the bevel 27 of the lip portion 25. The width of the rubber strip is slightly less than the width of the upper member portion 22. The beveled sides and smaller width significantly reduce the possibility of tearing the rubber strip 28 from the recess 26 under normal operation. The lip portion 25 is provided to protect the end of the rubber strip 28*b* from objects, particularly the instrument strings, which may tear the rubber strip from the upper member. The surface portion 28*c* of the rubber strip 28 that abuts the strings of the guitar is relatively wide so that the clamping force applied to the instrument strings is spread over a wide area of the strings. Application of the clamping force over a wide area reduces the physical distortion of the strings due to the clamping force and significantly reduces the tendency of the capo to distort the overall tuning of the strings.

Figure 7:
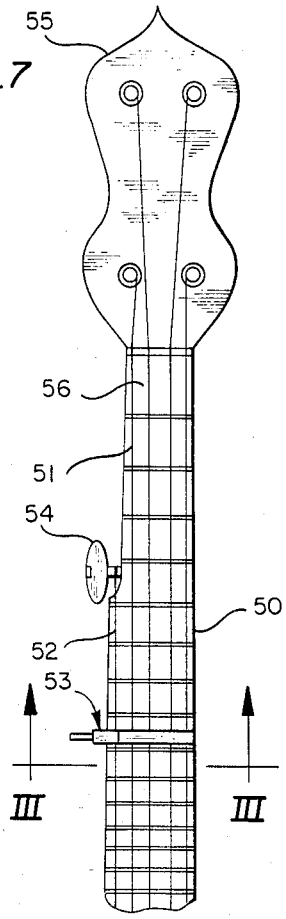
FIG. 7 is a partial plan view of a five string banjo neck portion and the second embodiment capo apparatus of this invention mounted thereupon.
Figure 8:
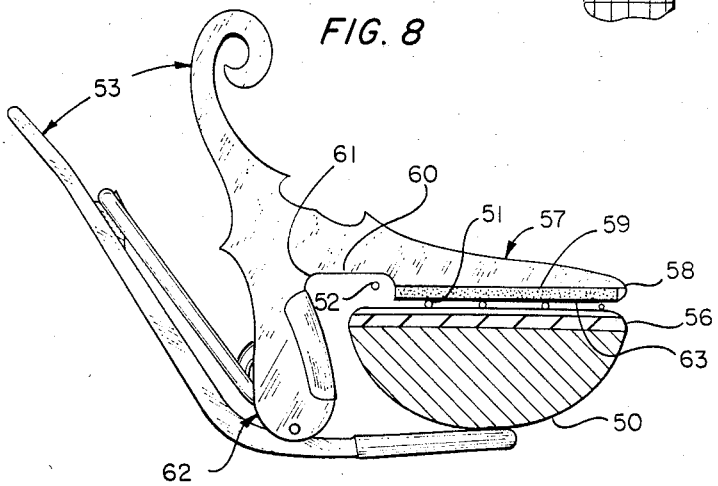
FIG. 8 is a cross sectional view of the five string banjo neck taken at arrows 3—3 of FIG. 7, showing a side view of the second embodiment apparatus of this invention.

Referring to FIG. 7 there is shown a plan view of a neck portion of a five string banjo, generally designated 50, which is generally constructed the same as the guitar neck in FIG. 1 except there are four long strings 51 and one short "fifth" string 52 and the second embodiment capo apparatus, generally designated 53, of this invention mounted on the banjo neck 50 in a position that spans all five strings. The tuning machine screw 54 for the fifth short string is located apart from the headpiece 55 of the banjo neck along the fretboard portion 56 of the neck. Referring to FIG. 8, there is shown a cross sectional view of the banjo neck portion generally taken along the line and in the direction of the arrows 3—3 in FIG. 7, that shows a side view of the second embodiment capo apparatus 53 of this invention in a clamped condition on the banjo neck 50.

Referring to FIGS. 7 and 8, the second embodiment of the capo 53 consists of the same general construction as the first embodiment capo 20, of this invention except that the upper member elongated portion 57 is constructed to engage the four long strings 51 while not engaging or interfering with the short fifth string 52. The upper member portion 57 terminates at the small end with a downward projecting lip 58 which forms one end of a downward projecting flat recess 59 that generally terminates at the opposite end at the beginning of a second deeper recess 60 that generally terminates at the inside surface 61 of the downward projecting leg 62 of the upper member 53.

The flat recessed surface 59 mounts a medium soft rubber strip 63 that is similar to the rubber strip 28 of the first embodiment but 63 is shorter in length. The rubber strip 63 is glued to the recessed surface 59 to permanently fasten the rubber strip 63 to the recess 59 in abutting relationship. The recess surface 59 is flat to match the flat fretboard 56 of the banjo neck 50. The second recess 60 of the upper member portion 57 is constructed with a depth and width large enough to avoid contact or interference with the short fifth string 52 when the capo 53 is mounted at a location on the banjo neck that contains all five strings as shown in the condition of FIG. 7.

Figure 9:
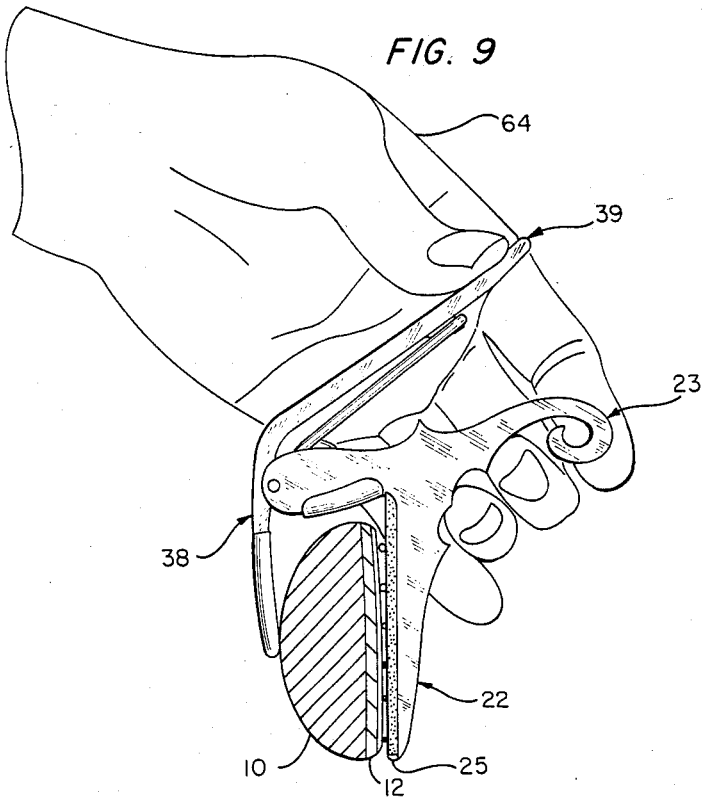
FIG. 9 is a cross sectional view similar to FIG. 2 but rotated 90° to FIG. 2, showing the left hand grasping the capo apparatus in the mounted position.
Figure 10:
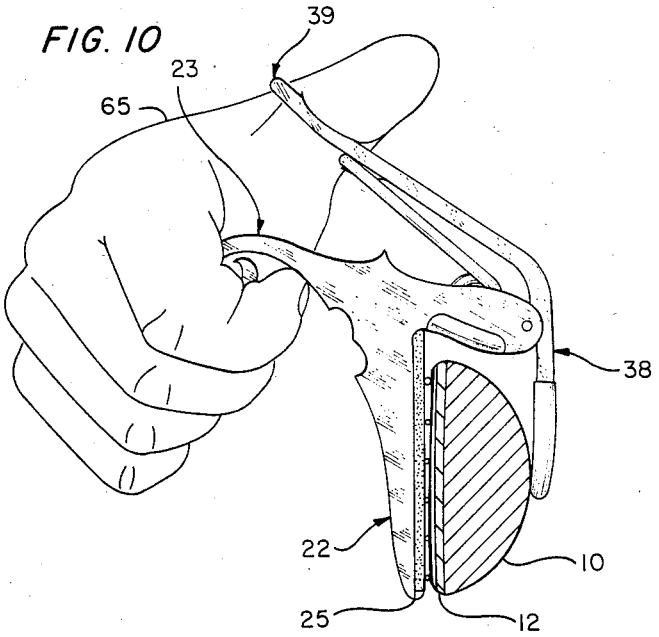
FIG. 10 is a cross sectional view similar to FIG. 2 looking along the line and in the direction of arrows 4—4 of FIG. 1 but rotated 90° showing the right hand grasping the capo apparatus in the mounted position.

To utilize either the first or second embodiment capos of this invention, the capo is grasped using either hand as shown in FIG. 9 and FIG. 10. Referring to FIG. 9, there is shown a cross section view of the guitar neck portion similar to FIG. 2 but rotated 90° to FIG. 2, showing a left hand 64 grasping the capo apparatus in a clamped condition on the neck 10. The illustration of the hand position 64 can be construed to show the situation just as the capo assumes a clamped condition, or it can be construed to show the situation just as the capo is grasped for removal from the clamped condition.

Referring to FIG. 10, there is shown a cross sectional view of the guitar neck portion taken along the line and in the direction of the arrows 4—4 of FIG. 1, showing a side view of the apparatus of this invention in a clamped condition on the neck 10, but rotated 90° from the plan view FIG. 1, and showing a right hand 65 grasping the capo apparatus in the clamped condition on the neck 10. As in FIG. 9, the illustration of hand position 65 in FIG. 10 can be construed to show the situation just as the capo assumes a clamped condition, or it can be construed to show the situation just as the capo is grasped for removal from the clamped condition.

FIG. 9 and FIG. 10 show the position of the neck 10 that is the normal position that would exist when the instrument is held for playing. The fretboard 12 of the neck 10 is shown in a vertical direction that is normal for playing the instruments. Although there are several other methods for grasping the capo apparatus with either the left or right hand, only the preferred methods are depicted in FIGS. 9 and 10.

To mount the capo on the instrument neck the upper member handle 39 are grasped as in FIGS. 9 or 10 and manual force applied to expand the capo clamping parts 22 and 38. With the clamping parts held apart the capo is positioned above the instrument neck and moved vertically down over the neck with part 22 on the string side and part 38 on the opposite side of the neck. The capo is positioned so that the lip part 25 is even with the neck edge and part 22 is aligned parallel with the frets of the fingerboard as shown in FIG. 1. When suitably positioned on the neck the manual force on the capo is released and the coiled tension spring forces the clamping parts 22 and 38 toward each other to force the strings down onto the fret in abutting relationship. The clamping force is sufficient to hold the capo fixed on the instrument neck under normal playing conditions.

In order to achieve the objective of not interfering with the fretboard playing hand, it is required that minimum structure is present above the fretboard and below the neck as well as no structure protruding past the edge of the neck on the side of the lip part 25. As shown in FIG. 2 the height of the upper member structural part 22 is small and the structure thickness becomes less and less toward the lip part 25. The capo structure configuration above the fretboard does not interfere with the fingers playing on the fretboard whether playing difficult chords such as B#7 or whether playing single notes. The lower member structural part 38 extends beneath the instrument neck to a point just past the center of the neck curved portion and is of a small thickness to avoid interfering with the playing hand thumb and palm. The portion of the neck beginning near the lip portion 25 and continuing directly to the lower member part 38 is completely free of capo structure.

Both the first and second embodiment capo apparatus of this invention are operated in the same manner. The capo upper and lower members can be constructed of aluminum, phenolic, plastic or other suitably rigid material.

I claim:

1. A capo mountable on the neck of a stringed musical instrument, comprising:

clamp means including an upper member with an upwardly projecting portion, a horizontal string engaging portion for pressing selected strings of the musical instrument against at least one fret of the musical instrument, and a downwardly projecting leg which together with the horizontal string engaging portion defines a downwardly facing recess for receiving the neck of the musical instrument;

a lower member having a clamping end and an opposite handle end which is rotatably joined to the downwardly projecting leg at a pivot point intermediate the clamping end and handle end, the handle end extending upwardly from the pivot point and being angled away from the upwardly projecting portion of the upper member, the handle end of the lower member and the upwardly projecting portion of the upper member together forming an elevated actuating mechanism for moving the clamp means between a neck clamping position and a non-clamping position; and biasing means for normally urging the clamping means toward the neck clamping position.

2. The capo of claim 1, wherein the horizontal string engaging portion has a lower surface which is lined with a resilient strip for contacting selected strings on the neck of the musical instrument.

3. The capo of claim 1, wherein the biasing means is a coil torsion spring which is mounted within a recess in the downwardly projecting leg and which has a hook end attached to a raised portion of the lower member handle end.

4. The capo of claim 1, wherein the pivot point at which the lower member is rotatably joined to the downwardly projecting leg is on an outer extent of the downwardly projecting leg, whereby the neck of the musical instrument can be received within the downwardly facing recess without laterally deflecting the strings thereof.

5. A capo mountable on the neck of a stringed musical instrument, comprising:

clamp means including an upper member with an upwardly projecting portion, a horizontal string engaging portion for pressing selected strings of the musical instrument against at least one fret of the musical instrument, and a downwardly projecting leg which together with the horizontal string engaging portion defines a downwardly facing recess for receiving the neck of the musical instrument;

a lower member having a clamping end and an opposite handle end which is rotatably joined to the downwardly projecting leg at a pivot point intermediate the clamping end and handle end, the handle end extending upwardly from the pivot point and being angled away from the upwardly projecting portion of the upper member, the handle end of the lower member and the upwardly projecting portion of the upper member together forming an elevated actuating mechanism for moving the clamp means between a neck clamping position and a non-clamping position;

biasing means for normally urging the clamping means toward the neck clamping position; and wherein the horizontal string engaging portion of the upper member has a stepped underside which forms a second, deeper recess for a string of the instrument which is not pressed against the fret when the clamp means is in place and in the neck clamping position.

* * * * *